US005715360A

United States Patent [19]

Montagnino

[11] Patent Number: 5,715,360

[45] Date of Patent: Feb. 3, 1998

[54] PULSE INJECTION STEAM HAIRSETTER

[75] Inventor: James G. Montagnino, El Paso, Tex.

[73] Assignee: Production Engineered Designs, Inc., El Paso, Tex.

[21] Appl. No.: 531,962

[22] Filed: Sep. 21, 1995

[51] Int. Cl.[6] ..... A45D 19/16; A45D 1/04

[52] U.S. Cl. ..... 392/403; 219/222; 132/272

[58] Field of Search ..... 392/400, 401, 392/402, 403, 405, 406; 219/222; 132/227, 228, 229, 212, 271, 272

[56] References Cited

U.S. PATENT DOCUMENTS

| | | | |
|---|---|---|---|
| 2,062,613 | 12/1936 | Schleimer | 392/405 |
| 3,493,722 | 2/1970 | Popeil | 219/222 |
| 3,700,853 | 10/1972 | Jensen et al. | 219/222 |
| 3,711,972 | 1/1973 | Risacher | 392/404 |
| 3,858,029 | 12/1974 | Walter | 219/222 |
| 4,398,364 | 8/1983 | Augustine et al. | 392/404 |
| 4,453,554 | 6/1984 | Caruso . | |
| 4,516,001 | 5/1985 | Jeffress et al. . | |
| 4,771,797 | 9/1988 | Kosaka . | |
| 4,810,854 | 3/1989 | Jursich et al. | 392/405 |
| 4,858,478 | 8/1989 | Kush et al. | 78/864.35 |
| 5,255,694 | 10/1993 | Caruso . | |
| 5,263,501 | 11/1993 | Maznik . | |
| 5,286,949 | 2/1994 | Simons . | |

*Primary Examiner*—Teresa J. Walberg
*Assistant Examiner*—Sam Paik
*Attorney, Agent, or Firm*—Watson Cole Stevens Davis, P.L.L.C.

[57] ABSTRACT

A pulse injection steam hairsetter which efficiently and safely heats hair curlers prior to use includes a housing that has a base for placement on a supporting surface and defines a recess for a replaceable water canister, the housing also defining a treatment chamber in which a hair curler can be placed and including a pulse steam supply mechanism for supplying pulses of steam to the treatment chamber, and more particularly to internally of a hair curler placed therein. The pulse steam supply mechanism includes an electric heating device for supplying steam to the treatment chamber, a manually operable bellows pump device, and hoses for delivering water from a water canister positioned in the recess to the bellows pump device and from the bellows pump device to the heating device. A one way valve between the bellows pump device and the heating device controls the flow of water in the proper direction. A cover can enclose the treatment chamber and be used to operate the bellows pump device. The heating device can include an apertured barrel that extends upwardly into the treatment chamber so as to extend axially along the center of a hair curler positioned therearound.

9 Claims, 3 Drawing Sheets

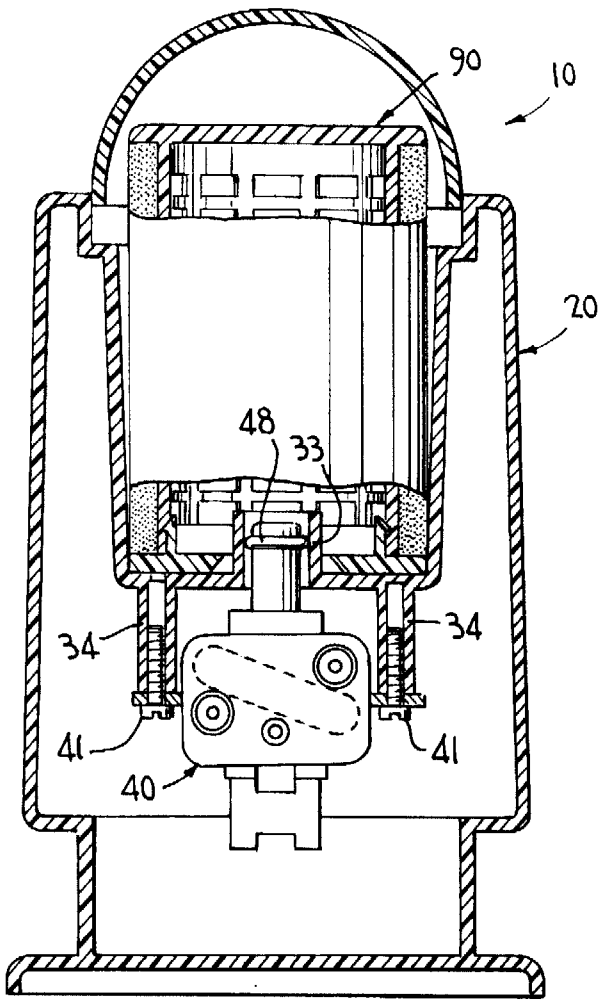
FIG. 2
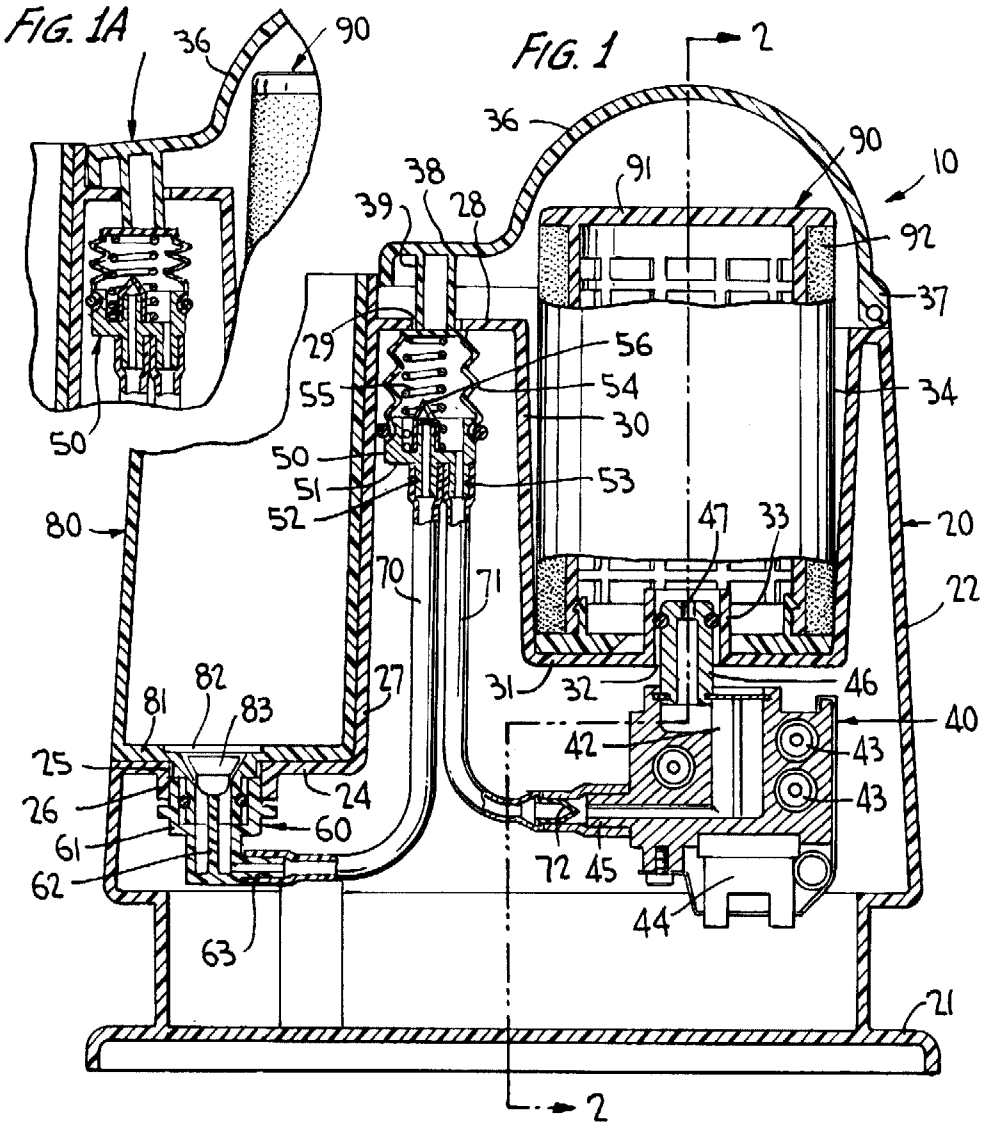
FIG. 1
FIG. 1A

PULSE INJECTION STEAM HAIRSETTER

BACKGROUND OF THE INVENTION

1. Field of the Invention

The present invention relates to steam hairsetters, and more specifically to steam hairsetters which are manually operable to inject pulses of steam into hair curlers to heat them prior to use.

2. The Prior Art

Steam hairsetter appliances for heating hair curlers prior to or during use have been available for many years. Although most such appliances operate to supply a continuous flow of steam into one or a group of hair curlers positioned within a chamber, some operate by manual activation to supply pulses of steam to the hair curlers. For example, U.S. Pat. No. 5,263,501 discloses a hand-held electric steam hair styling apparatus which includes a fluid reservoir, a heating element, a trigger-operated, pumping mechanism and an apertured barrel for insertion in a hair curler which has been wrapped with hair so as to input pulses of steam or heated vapor into the hair curler via operation of the trigger device to treat the hair wrapped therearound. U.S. Pat. No. 4,516,011 discloses a table top electric steamer for hair rollers which includes a housing that accommodates a water reservoir and includes a button-operated diaphragm pump to pump pulses of water from the water reservoir into an electric heater for vaporization into steam and injection into an exposed hair roller supported on a supporting member. The housing includes a hinged cover for covering a multiplicity of stored rollers, but not the hair roller being steamed. Because the roller being steamed is exposed, it is subject to heat loss to the surrounding atmosphere and undesirable exposure of adjacent objects and people to steam scalding.

It is an object of the present invention to provide a pulse injection steam hairsetter appliance for heating hair cutters prior to use and which is safe to use and efficient in operation.

SUMMARY OF THE INVENTION

According to the present invention the pulse injection steam hairsetter appliance includes a housing that is positionable on a flat surface when used and which provides a recess for a removable water canister and a treatment chamber in which a hair curler to be heated can be positioned, and which includes a pulse steam supply mechanism that includes an electric heating device and a manually operable, spring-biased bellows device to supply pulses of water from the water canister to the heating device for conversion to steam and delivery to the treatment chamber and the hair curler therein. In one preferred embodiment the housing includes a hinged cover which can be closed over the treatment chamber to thereby enclose the hair curler being steamed and thereby prevent heat loss and steam scalding, and the cover can include a pin which extends into the housing to contact and operate the bellows device by manual application of pressure on the cover. In another preferred embodiment the heater device can utilize an apertured barrel which extends upwardly into the treatment chamber and within a hair curler placed therearound in the treatment chamber to safely and evenly supply steam into the hair curler along its length.

Further features and advantages of the invention will be understood by reference to the accompanying drawings taken in conjunction with the following discussion.

BRIEF DESCRIPTION OF THE DRAWINGS

In the drawings,

FIG. 1 is a longitudinal sectional view of a pulse injection steam hairsetter appliance constructed according to a first embodiment of the present invention, FIG. 1A is a detail of the hairsetter appliance of FIG. 1 and showing operation of the bellows pump device therein, FIG. 2 is a transverse section of the hairsetter appliance as seen along line 2—2 of FIG. 1.

DETAILED DESCRIPTION OF THE PREFERRED EMBODIMENTS

Figure 3:
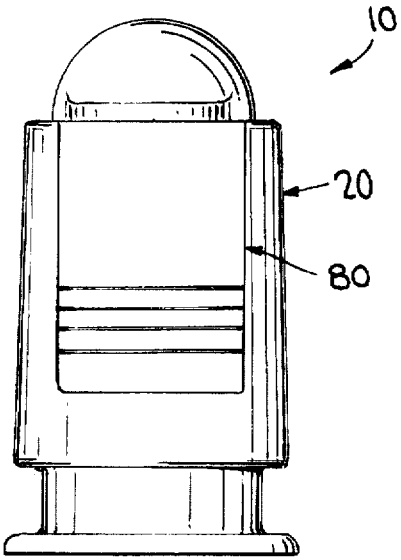
FIG. 3 is an elevational end view of the hairsetter appliance of FIG. 1.

A pulse injection steam hairsetter (wet set) appliance 10 according to a first embodiment of the present invention is shown in FIG. 1. It is adapted to steam heat a hair curler 90, which itself is formed by an apertured cylindrical frame 91 and a foam plastic cylindrical band 92 wrapped therearound. The hairsetter appliance includes an elongated housing 20 and a removable water canister 80.

Figure 5:
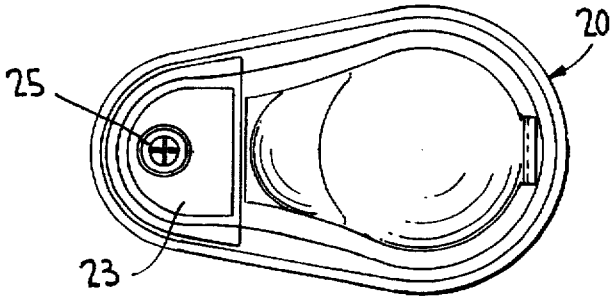
FIG. 5 is a top plan view of the housing of the hairsetter appliance.
Figure 6:
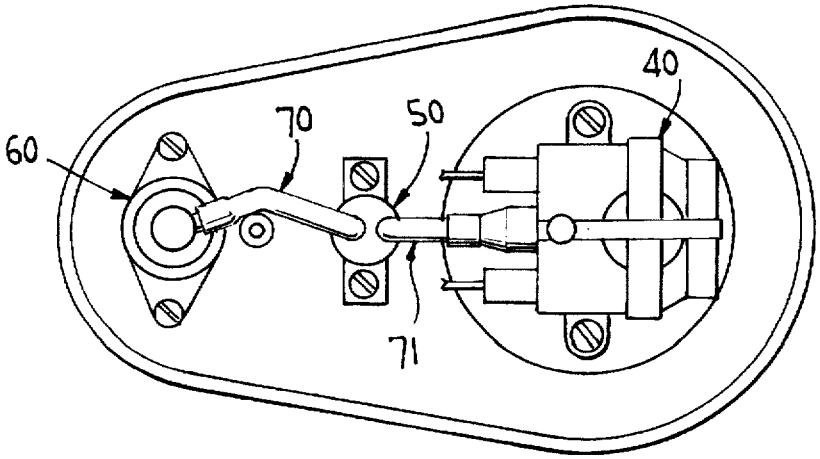
FIG. 6 is a bottom plan view thereof.

The elongated housing 20 includes a support base 21 for positioning on a flat supporting surface and an elongated outer shell 22 supported by the support base, one end of the shell having a recess 23 (see FIG. 5) formed therein by an inwardly-extending bottom wall 24 and a side wall 27. A top wall 28 extends from the side wall 27 to the shell 22 and, via a downwardly extending, generally cylindrical wall 30 and a floor 31, defines a treatment chamber 35 in which the hair curler 90 is positionable. The floor 31 provides a centrally located opening 32 and a cylindrical flange 33 therearound which extends upwardly into the treatment chamber 35. Legs 34 extend downwardly from the floor (see FIG. 2). A cover 36 is pivotally connected at an end 37 to the end of the housing opposite the recess 23, and when closed over the top wall 28, encloses the treatment chamber 35. The cover includes a lip 38 opposite its hinged end 37 which provides a pin 39 that, when the cover is in a closed position, extends downwardly through an opening 29 in the top wall between the treatment chamber 34 and the recess 23 (the functioning of this pin will be discussed below). The bottom wall 24 of the recess provides a opening 25 (see FIG. 5) therein and a downwardly extending cylindrical flange 26.

Mounted within the housing 20 is a pulse steam supply mechanism which includes an electric thermostat-controlled heating device 40, a bellows pump device 50, a connector element 60, and hoses 70, 71.

The electric thermostat-controlled heating device 40 is mounted beneath the floor 31 of the treatment chamber 34 by screws 41 which extend into the legs 34, and it includes a heating chamber 42 surrounded by heating elements 43, a thermostat 44 for controlling the heating elements, an inlet channel 45 for receiving pulses of water and conveying them into the heating chamber, and an outlet nozzle 46 having a discharge orifice 47 for discharging pulses of steam upwardly into the treatment chamber 35 and into a hair curler 90 positioned therein, the outlet nozzle extending upwardly through the opening 32 in the floor 31 of the treatment chamber and within the cylindrical flange 33 that extends into the treatment chamber. A ring gasket 48 located in a groove in the outlet nozzle 46 seals against the cylindrical flange 33 to prevent downward fluid drainage therebetween.

The bellows pump device 50 is positioned beneath the opening 29 in the top wall 28 and includes a mounting element 51 defining an inlet channel 52 and an outlet channel 53, a flexible bellows element 54 connected to the mounting element, a coil spring 55 positioned between the mounting element 51 and the top of the bellows element to bias the bellows element into an extended state, and a one-way valve element 56 in communication with the inlet channel 52.

The connector element 60 includes an adapter 61 which fits within the cylindrical flange 26 and provides an upwardly-extending stud 62 and an outlet channel 63. The functioning of the stud 62 will be clarified below.

The hose 70, which contains a coiled reinforcement spring (not shown) along its length, is connected between the inlet channel 52 of the bellows pump device 50 and the outlet channel 63 of the connector element 60. The hose 71, which also contains a coiled reinforcement spring (not shown) along its length, as well as a one-way valve element 72, is connected between the outlet channel 53 of the bellows pump device 50 and the inlet channel 45 of the heating device 40.

The removable water canister 80 is shaped to fit within the recess 23 in the housing, and it includes a floor 81 having a opening 82 therein that can be sealingly closed by a stopper 83, this stopper being displaced out of the opening by the stud 62 of the connector element 60 when the canister is positioned on the bottom wall 24. This enables water to flow through the opening 82 into the connector 60 and from there through the hose 70 to the bellows pump device 50 and subsequently through the hose 71 to the heating device 40.

Figure 4:
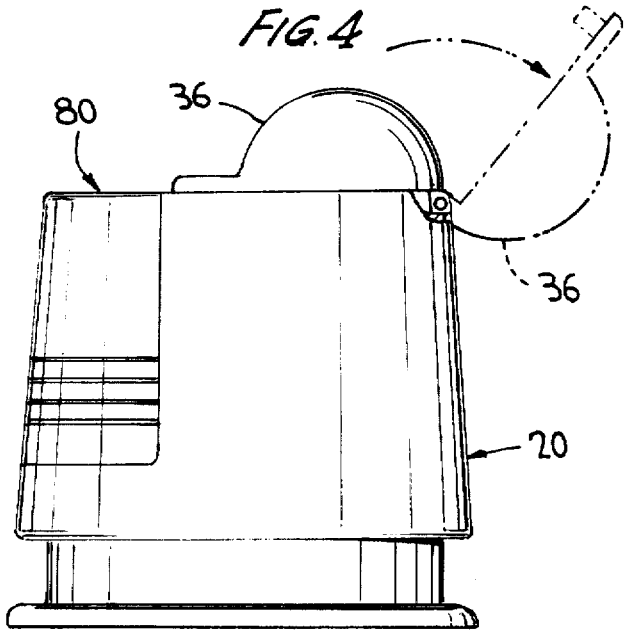
FIG. 4 is an elevational side view of the hairsetter appliance of FIG. 1, the cover thereof being shown in both a closed position (solid lines) and open position (phantom lines)

With the support base 21 of the housing 10 positioned on a flat supporting surface, a water canister 80 containing water is positioned within the recess 23 of the housing and on the bottom wall 24 such that the water therein can flow into the connector 60. A hair curler 90 to be heated is placed in the treatment chamber 34 so as to be located over the cylindrical flange 33, and the cover 36 is pivoted to a closed position. The heating device 40 is activated (the electrical cord to a power source is not shown) and the lip 38 of the cover is manually pumped against the top of the bellows element 54 and against the bias of the coil spring 55 (a downward pump action as shown in FIG. 1A), such that pulses of water are caused to flow from the connector element 60 to the bellows pump device and from the bellows pump device to the heating device, where the water pulses are heated to steam in the heating chamber 42 and passed through the outlet nozzle 46 into the hair curler in the treatment chamber. The one-way valve elements 56 and 72 control the flow of water pulses toward the heating device. The number and timing of manual pressings of the cover will determine the number and timing of steam pulses supplied to the hair curler and thus its temperature. Because the cover 39 encloses the treatment chamber, heat losses will be minimized and nearby objects and persons will be protected against steam exposure and burns. Pivoting the cover 39 to an open position (see FIG. 4) provides access to the treatment chamber and the heated hair curler therein for removal and use.

Figure 7:
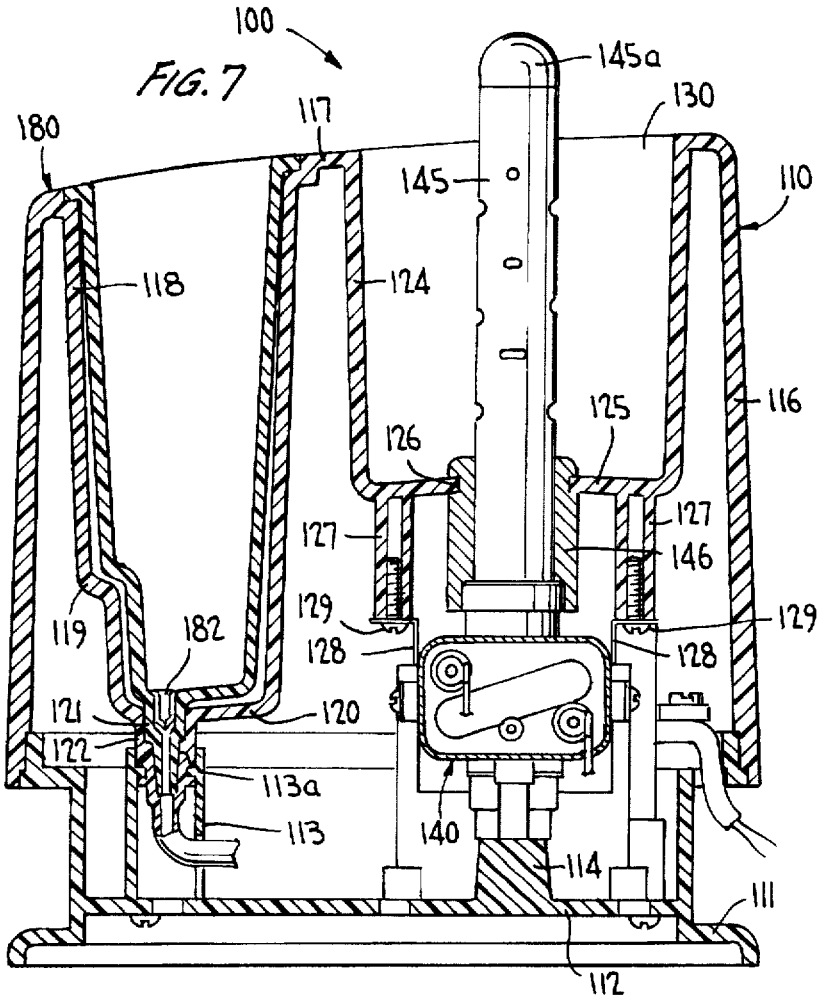
FIG. 7 is a longitudinal sectional view of a pulse injection steam hairsetter appliance constructed according to a second embodiment of the present invention.

A pulse injection steam hairsetter (vapor set) appliance 100, according to a second embodiment of the present invention is shown in FIG. 7. It includes an elongated housing 110 and a removable water canister 180.

Figure 9:
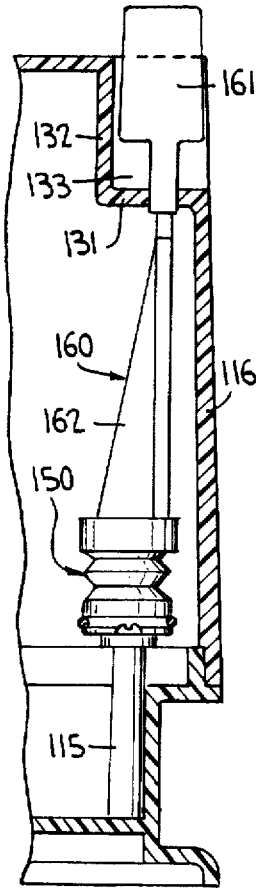
FIG. 9 is a sectional view of the hairsetter appliance as seen along line 9—9 of FIG. 8.
Figure 8:
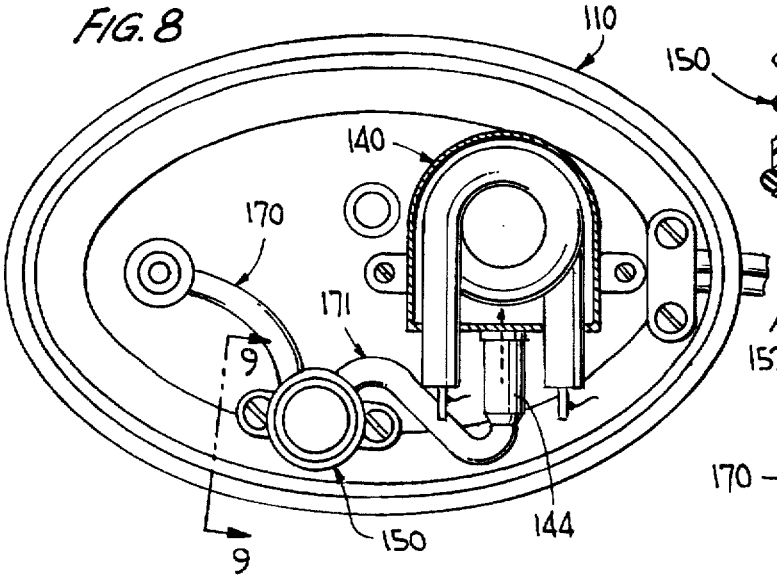
FIG. 8 is a bottom plan view thereof.
Figure 10:
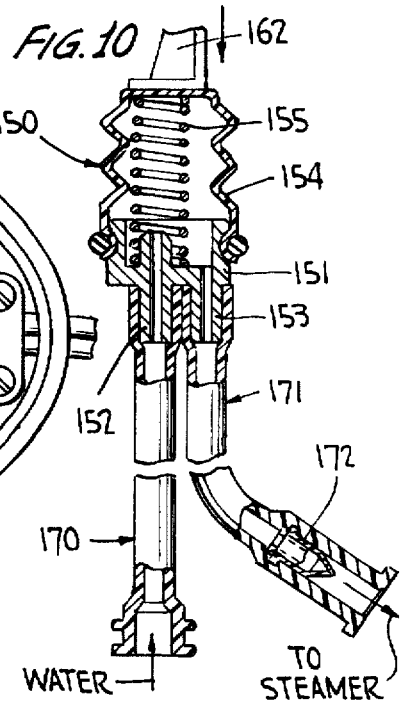
FIG. 10 is an enlarged detail of the bellows pump device and flexible hoses connected thereto.

The elongated housing 110 includes a support base 111 for positioning on a flat supporting surface, the base including an internal floor 112, an elongated outer shell 116 supported by the support base, and a top wall 117 which, via a downwardly extending, generally cylindrical wall 118 (except for a stepped portion 119) and a bottom wall 120, defines an internal recess 123 for the water canister, and via a downwardly-extending, generally cylindrical wall 124 and a bottom wall 125, defines an upwardly-open treatment chamber 130. The bottom wall provides a central opening 126 therein and legs 127 extend downwardly therefrom. Byway of a bottom wall 131 and a side wall 132, a recess 133 is formed in an upper side of the outer shell for a push button head 161 (see FIG. 9). The bottom wall 120 of the internal recess 123 provides an opening 121 and a downwardly-extending nozzle 122 that abuts a ledge **113*a* within a hollow cylindrical mounting platform 113 that extends upwardly from the floor 112**.

Mounted within the housing is a pulse steam supply mechanism which includes an electric thermostat-controlled heating device 140, a bellows pump device 150, a push button actuator device 160, and hoses 170,171.

The electric thermostat-controlled heating device 140 is mounted on a platform 114 that extends upwardly from the floor 112 beneath the treatment chamber 130 (the bottom wall 125 of the treatment chamber is connected to the heater device via flanges 128 which are connected to legs 127 by screws 129), and it includes a heating chamber surrounded by heating elements, a thermostat for controlling the heating elements, an inlet channel 144 for receiving pulses of water and conveying them to the heating chamber, and an apertured discharge barrel 145 with cool tip **145*a* which extends upwardly through the opening 126 in the bottom wall of the treatment chamber. An insulating ring 146 surrounds the discharge barrel where it passes through the opening 126 in the bottom wall 125** to seal with the bottom wall and prevent downward fluid leakage therebetween.

The bellows pump device 150, which is mounted on a pedestal platform 115 that extends upwardly from the floor 112, includes a mounting element 151 that defines an inlet channel 152 and an outlet channel 153, a flexible bellows element 154 connected to the mounting element, and a coil spring 155 positioned between the mounting element 151 and the top of the bellows element 154 to bias the bellows element into an extended state. The push button actuator device 160 includes a push button head 161 that is vertically movable in the recess 132 and an elongated flange element 162 which extends from the push button head 161 through an opening in the bottom wall 131 to connect with the top of the bellows element 154.

The hose 170 is connected between the inlet channel 152 of the bellows pump device 150 and the nozzle 122 (the end attached to the nozzle 122 is mounted within the ledge **113*a* of the platform 113). The hose 171 is connected between the outlet channel 153 of the bellows pump device 150 and the inlet channel 144 of the heating device 140, and it includes a one-way valve element 172**.

The removable water canister 180 is shaped to fit within the internal recess 123 in the housing (it includes a ledge that corresponds to stepped portion 119 of the generally cylindrical wall 118) and such that a drain nozzle 181 thereof will fit within the nozzle 122. The drain nozzle 181 contains a one way valve element 182 which prevents water drainage when the water canister is removed from the internal recess but allows water flow therethrough when the bellows pump device 150 is activated.

With the support base 111 of the housing 100 positioned on a flat supporting surface, a water canister 180 containing water is positioned with the internal recess 123 of the housing such that water can flow into the hose 170. A hair curler to be heated is placed in the treatment chamber and around the apertured discharge barrel 145. The heating device is activated and the push button head 161 is pressed down and then released so that the flange element 162 will cause the bellows element 154 to contract against the bias of the coil spring 155 and then be released. The compression of the bellows will cause water from within the bellows to flow through the hose 171 into the heater device 140 while the expansion of the bellows due to return action by the spring 155 will cause replacement water from the water canister to flow through the hose 170 into the bellows element. Water in the heater device is heated to steam, which is passed into the barrel 145 and out from its apertures into a hair curler positioned therearound. Because the housing is positioned on a supporting surface, it is safer to use than portable hand-held steamers (see U.S. Pat. No. 5,263,501).

Although two embodiments of the invention have been shown and described, modifications therein can be made and still fall within the scope of the invention. For example, the housing could be modified to use multiple heating devices so as to heat multiple hair curlers, either in a single treatment chamber or in separate treatment chambers. The inventive appliance can be used to vaporize liquids other than water, if desired.

I claim:

1. A pulse injection steam hairsetter appliance which comprises a removable water canister, a housing, and a pulse supply mechanism within said housing;

said housing defining a recess for receiving the water canister, a treatment chamber for a hair curler, a hinged cover for enclosing said treatment chamber and a hair curler positioned therein, and a base for operative placement on a flat supporting surface; said treatment chamber being formed by a generally cylindrical side wall and a first bottom wall, said first bottom wall providing an opening therein and a cylindrical flange which extends upwardly into said treatment chamber; and said pulse steam supply mechanism comprising a heating device defining a heating chamber with heating elements therearound and a discharge nozzle which extends upwardly within said cylindrical flange of said first bottom wall of said treatment chamber, a manually operable bellows pump device, a first hose extending between said recess and said bellows pump device, a second flexible hose extending between said bellows pump device and said heating device, and a first one-way valve in said second hose such that when a water canister is positioned in said recess and said bellows pump device is manually operated, pulses of water will flow through said first and second hoses to said heating device to be converted into steam and supplied to said treatment chamber and to a hair curler positioned therein.

2. A pulse injection steam hairsetter appliance according to claim 2, wherein said bellows pump device includes a mounting element defining an inlet channel and an outlet channel, a flexible bellows element attached to the mounting element, and a coil spring positioned between said mounting element and a top of said bellows element to bias said bellows element in an extended state.

3. A pulse injection steam hairsetter appliance according to claim 2, including a second one-way valve element in communication with said inlet channel of said bellows pump device.

4. A pulse injection steam hairsetter appliance according to claim 1, including a ring gasket located between said discharge nozzle and said cylindrical flange to prevent fluid drainage therebetween.

5. A pulse injection steam hairsetter appliance according to claim 2, wherein said recess is defined by a second bottom wall and a side wall, said second bottom wall including an opening therein, and wherein said water canister includes a floor which defines a valved opening therein that communicates with said opening in said second bottom wall.

6. A pulse injection steam hairsetter appliance according to claim 5, wherein said water canister includes a movable stopper located in said opening in said floor thereof, and wherein said pulse water supply mechanism includes a connector element positioned beneath said opening in said second bottom wall, said connector including an upwardly-extending stud which can move said stopper to open said opening in said floor of said water canister when said water canister is operatively positioned in said recess.

7. A pulse injection steam hairsetter appliance which comprises a removable water canister, a housing, and a pulse supply mechanism within said housing; said housing defining an outer shell, a top wall, a recess for receiving the water canister, a treatment chamber for a hair curler, a hinged cover for enclosing said treatment chamber and a hair curler positioned therein and a base for operative placement on a flat supporting surface; and said pulse steam supply mechanism comprising a heating device defining a heating chamber and an outlet means for discharging steam into said treatment chamber, a manually operable bellows pump device, a first hose extending between said recess and said bellows pump device, a second flexible hose extending between said bellows pump device and said heating device, a first one-way valve in said second hose such that when a water canister is positioned in said recess and said bellows pump device is manually operated, pulses of water will flow through said first and second hoses to said heating device to be converted into steam and supplied to said treatment chamber and to a hair curler positioned therein; said cover of said housing including a pin which, when the cover is in a closed position, extends through an opening in the top wall to operate said bellows pump device when cover is manually pressed.

8. A pulse injection steam hairsetter appliance which comprises a removable water canister, a housing, and a pulse supply mechanism within said housing; said housing defining a recess for receiving the water canister, a treatment chamber for a hair curler formed by a generally cylindrical side wall and a bottom wall having an opening therein and a base for operative placement on a flat supporting surface; and said pulse steam supply mechanism comprising a heating device defining a heating chamber, an apertured discharge barrel which sealingly extends from said heating device through said opening in said bottom wall and into said treatment chamber for lateral discharge of steam into a hair curler positioned therearound, a manually operable bellows pump device, a first hose extending between said recess and said bellows pump device, a second flexible hose extending between said bellows pump device and said heating device, and a first one-way valve in said second hose such that when a water canister is positioned in said recess and said bellows pump device is manually operated, pulses of water will flow through said first and second hoses to said heating device to be converted into steam and supplied to said apertured barrel and laterally into a hair curler positioned therearound.

9. A pulse injection steam hairsetter appliance according to claim 8, wherein said pulse steam supply mechanism includes a push button actuator device operatively connected to said bellows pump device.

* * * * *